US005713148A

United States Patent [19]

Lovison

[11] Patent Number: 5,713,148

[45] Date of Patent: Feb. 3, 1998

[54] FRAME WITH PICTURE HOLDER

[75] Inventor: Douglas I. Lovison, Carlsbad, Calif.

[73] Assignee: Chromium Graphics Inc., Vista, Calif.

[21] Appl. No.: 648,385

[22] Filed: May 15, 1996

Related U.S. Application Data

[63] Continuation-in-part of Ser. No. 310,278, Sep. 21, 1994, abandoned.

[51] Int. Cl.[6] ..... G09F 1/12

[52] U.S. Cl. ..... 40/776; 40/762

[58] Field of Search ..... 40/661, 745, 762, 40/772, 776; 248/455, 457

[56] References Cited

U.S. PATENT DOCUMENTS

| | | | |
|---|---|---|---|
| 460,663 | 10/1891 | Searvogle . | |
| 859,199 | 7/1907 | Chinnery . | |
| 1,252,918 | 1/1918 | McNicholas . | |
| 1,270,475 | 6/1918 | Wilkenson . | |
| 1,356,892 | 10/1920 | Stevens . | |
| 1,694,847 | 12/1928 | Donaldson . | |
| 1,802,999 | 4/1931 | Budd . | |
| 1,867,314 | 7/1932 | Gurwick . | |
| 1,980,453 | 11/1934 | Tucker et al. . | |
| 2,235,791 | 3/1941 | Wohlers . | |
| 2,253,814 | 8/1941 | Sames | 40/776 |
| 2,647,834 | 8/1953 | Rabkin et al. . | |
| 2,697,889 | 12/1954 | Heim . | |
| 2,737,745 | 3/1956 | Hartmann . | |
| 2,846,238 | 8/1958 | Nickow et al. . | |
| 3,046,853 | 7/1962 | Legendre . | |
| 3,408,759 | 11/1968 | Rotheraine et al. . | |
| 3,587,187 | 6/1971 | Sibley . | |
| 3,642,552 | 2/1972 | Sibley . | |
| 3,686,784 | 8/1972 | Hirsch et al. . | |
| 3,789,529 | 2/1974 | Thom . | |
| 3,805,049 | 4/1974 | Frank et al. . | |
| 3,813,799 | 6/1974 | Caravello | 40/762 X |
| 3,836,419 | 9/1974 | Hamberger . | |
| 3,900,641 | 8/1975 | Woodman et al. . | |
| 3,931,425 | 1/1976 | Kuroda . | |
| 3,956,838 | 5/1976 | Gerrish . | |
| 4,067,129 | 1/1978 | Abramson et al. . | |
| 4,104,867 | 8/1978 | Worsham . | |
| 4,127,689 | 11/1978 | Holt . | |
| 4,138,786 | 2/1979 | Smith . | |
| 4,231,833 | 11/1980 | Lieberman . | |
| 4,500,374 | 2/1985 | Nakazima . | |
| 4,721,635 | 1/1988 | Helinski . | |
| 4,771,557 | 9/1988 | Bowman . | |
| 4,791,010 | 12/1988 | Hanley et al. . | |
| 4,848,014 | 7/1989 | Yesbick . | |
| 4,852,281 | 8/1989 | Blome et al. | 40/762 |
| 4,933,218 | 6/1990 | Longobardi . | |
| 4,939,858 | 7/1990 | Dailey | 40/762 X |
| 4,947,566 | 8/1990 | Hoebel . | |
| 4,952,462 | 8/1990 | Bright . | |
| 5,010,672 | 4/1991 | Coleman . | |
| 5,072,532 | 12/1991 | Kelly . | |

(List continued on next page.)

FOREIGN PATENT DOCUMENTS

| | | |
|---|---|---|
| 0298687 | 11/1989 | European Pat. Off. . |
| 78 27040 | 9/1978 | France . |
| 3247964 | 12/1982 | Germany . |
| 1040995 | 9/1966 | United Kingdom . |
| 2234434 | 2/1991 | United Kingdom . |

*Primary Examiner*—Joanne Silbermann
*Attorney, Agent, or Firm*—Nydegger & Associates

[57] ABSTRACT

A frame for holding a picture includes a die cut border formed with an aperture and a substantially flat flexible plastic envelope formed with a pocket. The picture is insertable into the pocket of the envelope, and the envelope is attached to the border for presenting the picture through the aperture. A brace is selectively attachable to the border to hold the frame in a desired orientation for viewing the picture. Alternatively, the envelope may be formed between a recessed portion of a rigid base and a transparent sheet attached over the recess and the brace may be removeably attachable to the base member and further be configured to be attachable to the base member in more than one predetermined orientation.

10 Claims, 4 Drawing Sheets

U.S. PATENT DOCUMENTS 5,096,752 3/1992 Wagner ..... 40/776 X
5,105,567 4/1992 Real .
5,106,126 4/1992 Longobardi et al. .
5,133,450 7/1992 Rademacher .
5,222,315 6/1993 Lovison ..... 40/745 X
5,323,551 6/1994 Lovison et al. ..... 40/745 X
5,400,532 3/1995 Grove .
5,404,663 4/1995 Schober .

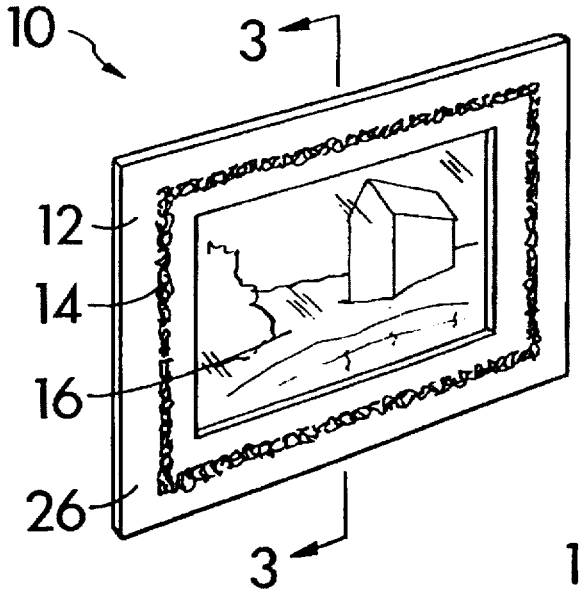
FIGURE 1
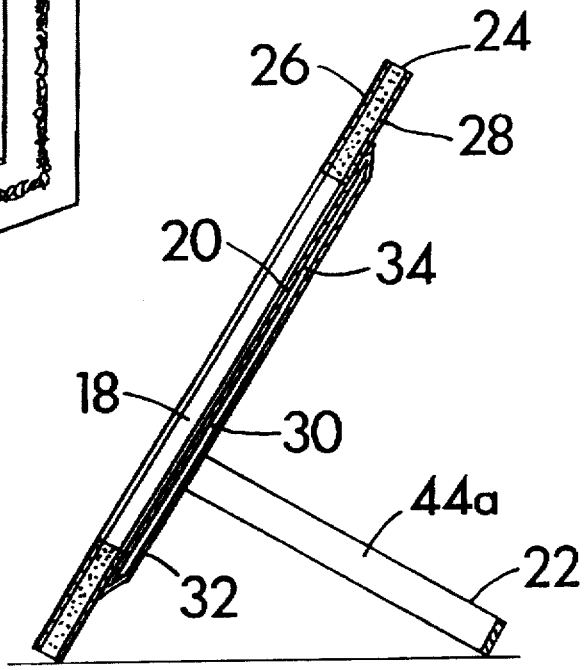
FIGURE 3
FIGURE 2
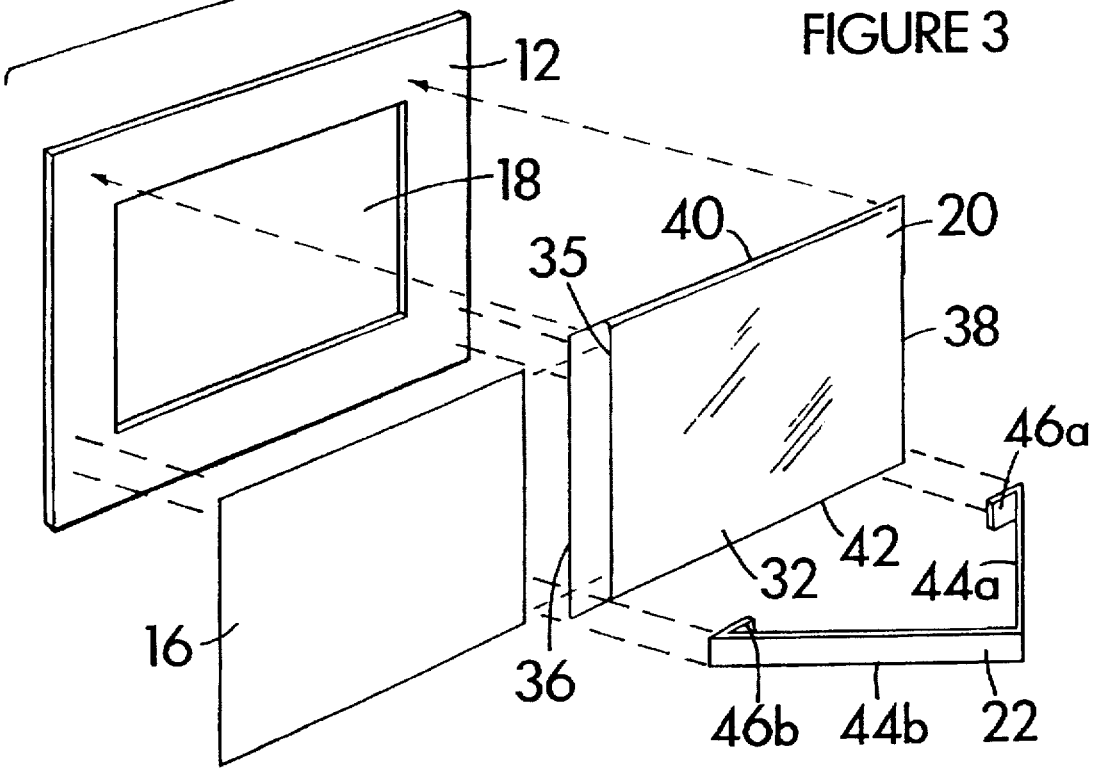

FRAME WITH PICTURE HOLDER

This is a continuation-in-part patent application of U.S. patent application Ser. No. 08/310,278, filed on Sep. 21, 1994, and entitled "Frame with Picture holder", now abandoned.

FIELD OF THE INVENTION

This invention pertains generally to picture frames. More particularly, the present invention pertains to picture frames which are conveniently assembled using easily fabricated components. The present invention is particularly, but not exclusively, useful as a picture frame in which the major component parts are made from plastic films, and die cut and injection molded materials.

BACKGROUND OF THE INVENTION

Picture frames come in a wide variety of shapes and sizes, and typically have at least some artistic or aesthetic value. As is well known, there are many ways in which a picture frame can be manufactured.

One type of picture frame which is commonly used incorporates a border which forms an aperture and surrounds the picture or document that is viewed. For this type of picture frame, the picture itself is typically held across the aperture between a back board and a piece of glass. To accomplish this, the backboard is generally attached to the border and the piece of glass, or some other light transparent protective structure, is held between the back board and the border to cover the front of the picture. The picture can then be viewed through the aperture in the border of the picture frame. This is a "traditional" type picture frame, and it is the preferred type picture frame for many and varied situations.

Not surprisingly, borders and associated components for traditional picture frames can be manufactured in many different ways, using many different kinds of materials. For instance, metal picture frames can be integrally molded, welded together from individual components or assembled with screws. Further, wooded picture frames can be carved or cut and then glued or nailed together as necessary. Still further, plastic picture frames can be injection molded as a complete frame or component parts can be molded and then connected by glue, nails or screws. In each case, the result is often a nice rigid traditional type picture frame which has aesthetic appeal and which is effective for its intended purpose.

For many constructions of a traditional picture frame, the manufacture and assembly of the frame can be labor intensive. This is so regardless whether the manufacture of individual picture frame components is by molding, carving, cutting or shaping. Indeed, in some cases, the labor required can be excessive. On the one hand, this is acceptable for many consumers who want and appreciate the art work associated with the frame. On the other hand, many consumers need to be cost conscious and are willing to accept picture frames which, though they have some aesthetic appeal, are more functional.

An additional aspect of traditional picture frames is the stand or brace. This brace is designed to support the picture frame such that the frame is displayable on a tabletop or other horizontal surface. Normally, such a brace serves to hold the traditional picture frame in a generally upright orientation with the picture frame canted back slightly to facilitate viewing of the picture. The brace for such a picture frame may either be fixed in a single position, such as when the brace is molded as part of the frame itself, or the brace can be hinged to the back of the picture frame. For this hinged-type brace, the frame is not limited to being displayed on a horizontal surface. If desired, the hinged brace can be collapsed against the frame so that the frame can be hung from a wall. Additionally, either type of traditional brace usually permits the picture frame to be displayed in at least two different orientations with respect to the table top. Specifically, these traditional braces generally provide for both vertical and horizontal orientations.

The present invention recognizes that a picture frame can be manufactured using easily manufactured die cut or injection molded major individual components, and cut plastic sheets. By using such components, the manufacture of the picture frame components is simplified. Further, and consequently, the assembly of picture frame components is also simplified.

In light of the above, it is an object of the present invention to provide a picture frame, and its method of manufacture, which uses cut plastic sheets and die cut or injection molded materials as the major individual components of the picture frame. It is another object of the present invention to provide a picture frame, and its method of manufacture, which presents a traditional type picture frame that is made from easily assembled components. A still further object of the present invention is to provide a brace or stand made from easily manufactured die cut or injection molded materials that snaps on to and off of the picture frame and further can also be attached such that the picture frame can be displayed in more than one predetermined orientation. Still another object of the present invention is to provide a picture frame which is easy to use, simple to manufacture and comparatively cost effective.

SUMMARY OF THE PREFERRED EMBODIMENTS

A picture frame in accordance with the present invention includes a border which has a support member that is made from a die cut core material. An aperture is formed which is surrounded by the border. For the picture frame of the present invention the border has a first surface and a second surface which are each covered by a respective conformable die cut layer. In order to establish an aesthetic appeal for the picture frame, the die cut layer on the first surface can have a design. This design may be printed on the layer in any manner known in the pertinent art.

Also included in the picture frame of the present invention is an envelope. The envelope is formed to create a pocket and it has an opening which provides access into the pocket. The envelope is substantially rectangular and includes a first sheet and a second sheet which are joined together along three of their corresponding edges. Thus, the opening is established along the corresponding unjoined fourth edge. Through this opening a picture can be inserted into the pocket and held therein. The sheets of the envelope can be die cut or otherwise cut, and are preferably made of a clear transparent plastic.

In the assembly of the picture frame, portions of the first sheet, or alternatively, the base member are attached to the border to present the picture in the envelope for viewing through the aperture.

A brace, which is substantially a formable plastic strip can be shaped and attached to the border to support the picture frame. The brace can also be die cut.

In an alternative embodiment of the present invention, the frame assembly includes a base member which is made of a rigid material, such as injection molded plastic. The base member is formed with a recess and an aperture is formed through the base that provides access to the recess from the back of the base. The base member is also formed with a ledge which extends around the periphery of the recess. This ledge is dimensioned and configured to receive the edges of a transparent sheet thereon. With these structural elements, when the transparent sheet is attached to the front side of the base at the ledge, it covers the recess to create a pocket between the transparent sheet and the base member. A picture can be inserted through the aperture and into the pocket. Once slipped into the pocket, the picture can be viewed through the transparent sheet.

Additional features of the alternative base member are pairs of retainer rings projecting from its back side. Specifically, the base member includes at least one pair of retainer rings which project from its back side to provide an attachment point for an alternative brace. This brace can be injection molded, and includes a wide base and a pair of flexible arms extending from it. At the tip of each arm is a pin. The respective pins of each arm are coaxial and extend outwardly from each arm so that when the arms are pressed together to a first configuration, the pins can pass between the retainer rings. Attachment of the alternative brace is completed by releasing the arms, such that each of the pins move in a direction away from each other and into a respective retainer ring. The alternative brace can be detached by simply pressing the arms together until the pins are disengaged from the retainer rings.

The alternative brace can be attached to the base such that the picture frame can be displayed on a horizontal surface. The brace can also be easily detached from the base so that the picture frame can be hung from a wall. More than one pair of retainer rings may be formed on the base member to provide more than one orientation option for displaying the picture frame on a horizontal surface.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which:

FIG. 1 is a front perspective view of the picture frame of the present invention;

FIG. 2 is an exploded perspective view of the picture frame seen from the rear showing its basic component parts;

FIG. 3 is a cross section view of the picture frame as seen along the line 3—3 in FIG. 1 without a picture inserted into the envelope of the picture frame;

DESCRIPTION OF THE PREFERRED EMBODIMENT

Figure 4:
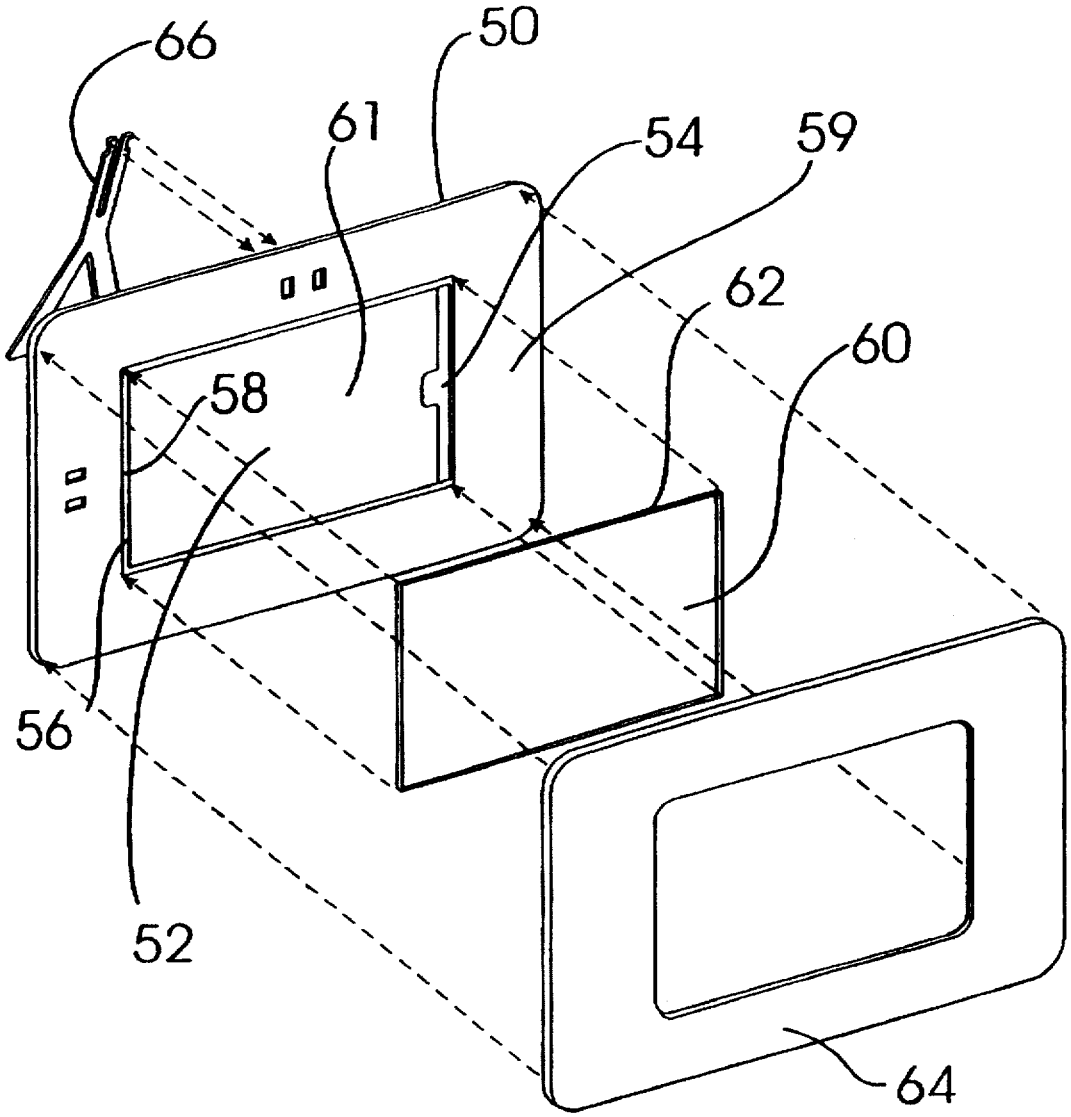
FIG. 4 is an exploded perspective view of an alternative embodiment of the picture frame showing an arrangement of component parts.

A picture frame according to the present invention is shown in FIG. 1 and generally designated 10. As shown, the picture frame 10 includes a border 12 with a design 14 which holds a picture 16 (or some other presentation, such as a document).

In FIG. 2 it can be seen that the picture frame 10 is formed to surround an aperture 18. FIG. 2 also shows that the picture frame 10 includes an envelope 20 and a brace 22. More specifically, as intended for the present invention, the picture is inserted into the envelope 20 which is then attached to the border 12 to present the picture 16 in aperture 18. The brace 22 is then attached to border 12 to hold picture frame 10 in a predetermined orientation for viewing picture 16.

The construction of border 12 will perhaps be best appreciated by reference to FIG. 3. There it will be seen that the border 12 includes a support member 24, a first layer 26 which is attached to a surface of the support member 24, and a second layer 28 which is also attached to a surface of the support member 24. The support member 24 of border 12 is preferably made of a rigid material, such as a foam core, which can be die cut into any particularly desired shape. The rectangular configuration for support member 24 shown in the Figures is only exemplary. Additionally, first layer 26 and second layer 28 are preferably made of a plastic material which can also be die cut in the dimensions and shape to be conformable with support member 24. For aesthetic purposes, the design 14 can be placed on first layer 26 by any manner well known in the pertinent art, such as a four color printing process.

Still referring to FIG. 3, with cross referencing back to FIG. 2, it will be seen that envelope 20 includes a first sheet 30 and a second sheet 32 which are joined together to form a pocket 34 having an opening 35. More specifically, as shown in FIG. 2, first sheet 30 has a first end 36 and a second end 38, with a first side 40 and a second side 42 extending substantially parallel to each other between the ends 36, 38. The second sheet 32 is shown joined to first sheet 30 at the second end 38 and along both of the sides 40, 42. This construction forms the pocket 34, and leaves the opening 35 at the first end 36 of sheet 30 available for insertion of picture 16 into pocket 34. Preferably, both first sheet 30 and second sheet 32 are made of a transparent material, such as plastic, which can be easily cut into any desired shape with selected dimensions.

FIG. 2 also shows that the picture frame 10 of the present invention includes a brace 22. Preferably, brace 22 can be die cut like the other components of picture frame 10. After being die cut, brace 22 is bendable to form the legs **44*a* and 44*b*, as shown. Further, brace 22 is bendable to form the attachment tabs 46*a* and 46*b***.

In the assembly of the picture frame 10, first end 36 and second end 38 of envelope 20 are attached to the border 12 to substantially cover aperture 18 with envelope 20. For purposes of the present invention, the ends 36, 38 of envelope 20 can be attached to border 12 in any manner well known in the pertinent art, such as by gluing. A picture 16 can then be inserted through opening 35 and into the pocket 34 of envelope 20. Thus, picture 16 can be viewed through aperture 18. Additionally, tabs **46*a* and 46*b* of brace 22 can be attached to the border 12. Preferably, the tabs 46*a* and 46*b* of brace 22 have an adhesive (not shown) deposited thereon which will cause the tabs 46*a* and 46*b* to stick to border 12. The result is a picture frame which can hold a picture 16 and, depending on where the brace 22 is attached to border 12, the picture 16** can be displayed in any particularly desired orientation.

As is to be appreciated in reference to FIG. 4, the base 50 of an alternative embodiment of the present invention is made of a rigid material, such as injection molded plastic. The base 50 includes a recess 52, having an aperture 54 and also including a ledge 56 which extends around the periphery 58 of the recess 52. The base 50 is substantially rectangular and is further defined by a rim 59 having four sides.

In this alternative embodiment, a sheet 60, preferably made from a transparent material, such as die cut plastic, is attached to the ledge 56. Specifically, the edges 62 of the sheet 60 are affixed to the ledge 56 in any manner well known in the pertinent art, such as by gluing or other chemical bonding. The ledge 56 is raised above the surface 61 of the recess 52, such that when the edges 62 of the sheet 60 are attached to the ledge 56, over the recess 52, the sheet 60 and recess 52 form a pocket for receiving a picture (not shown) through the aperture Also shown in FIG. 4 is a border 64, that can be manufactured as described above, such as from foam core material. The border 64 may further include a design facing outwardly (not shown).

Figure 5:
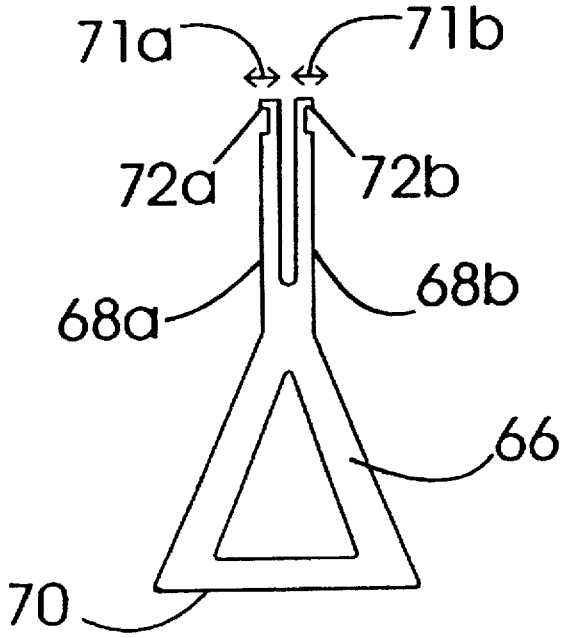
FIG. 5 is a front view of a brace usable with an alternative embodiment of the present invention.

The picture frame assembly for the alternate embodiment of the present invention further includes a brace 66, which is best seen by initial reference to FIG. 5. As shown in FIG. 5, the brace 66 includes a pair of parallel arms 68*a* and 68*b* extending from a wide base portion 70. The arms 68 terminate in pins 72*a* and 72*b*. The pins 72*a* and 72*b* are coaxial and extend away from one another. The brace 66 can be made from injection molded plastic such that it is generally rigid but allows the arms 68*a* and 68*b* to be somewhat flexible in the directions indicated by the arrows 71*a* and 71*b*.

Figure 6:
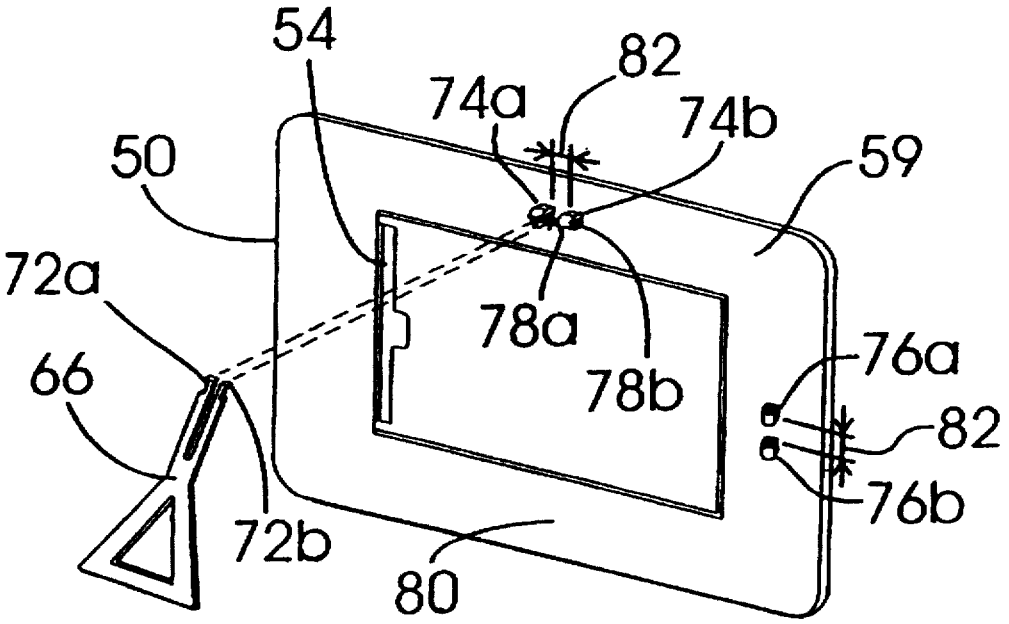
FIG. 6 is an exploded perspective view as seen from the rear of an alternative embodiment of the picture frame showing an attachment arrangement of the brace.

FIG. 6 depicts the attachment of the alternative brace 66 to the base 50. As seen from the rear in FIG. 6, the base 50 further includes two pairs of retainer rings 74*a*, 74*b* and 76*a*, 76*b* projecting from the back side 80 of the base 50. The retainer ring pairs 74 and 76 are formed in pre-determined orientations on adjacent sides of the rim 59 of the base 50 to permit the brace 66 to be attached to the base 50 in more than one alternative position. The retainer ring pairs 74 and 76 are preferably arched protrusions formed on the back side 80 of the base 50. The individual retainer rings, 74*a* and 74*b* are separated from each other by a gap 82. Similarly, the retainer rings 76*a* and 76*b* are separated by a gap which is essentially the same as gap 82.

For purposes of discussion consider the pins of retainer rings 74. As shown in FIG. 6, each retainer ring, 74*a*, 74*b* for example, further includes a respective hole 78*a*, 78*b*. The holes 78 are the correct size to receive the pins 72*a*, 72*b* of the brace 66 therein. Thus, the brace 66 can be snapped into the retainer ring pair 74 by pressing the arms 68*a* and 68*b* together as indicated by the arrows 71*a*, 71*b* in FIG. 5, so that the pins 72*a* and 72*b* can pass between the retainer rings 74*a*, 74*b*. Once the pins 72*a* and 72*b* are inserted between the retainer rings 74*a*, 74*b*, the arms 68*a* and 68*b* are released. When released, the arms 68*a* and 68*b* will return to their generally parallel alignment and force the pins 72*a* and 72*b* away from each other and into the holes 78*a*, 78*b* of their respective retainer rings, 74*a* and 74*b*. The brace 66 can therefore be attached to and detached from the base 50 at will without requiring any gluing or other permanent method of adhesion. Furthermore, the retainer rings 74 are rigid such that they provide adequate structural integrity to support the brace 66.

Figure 7:
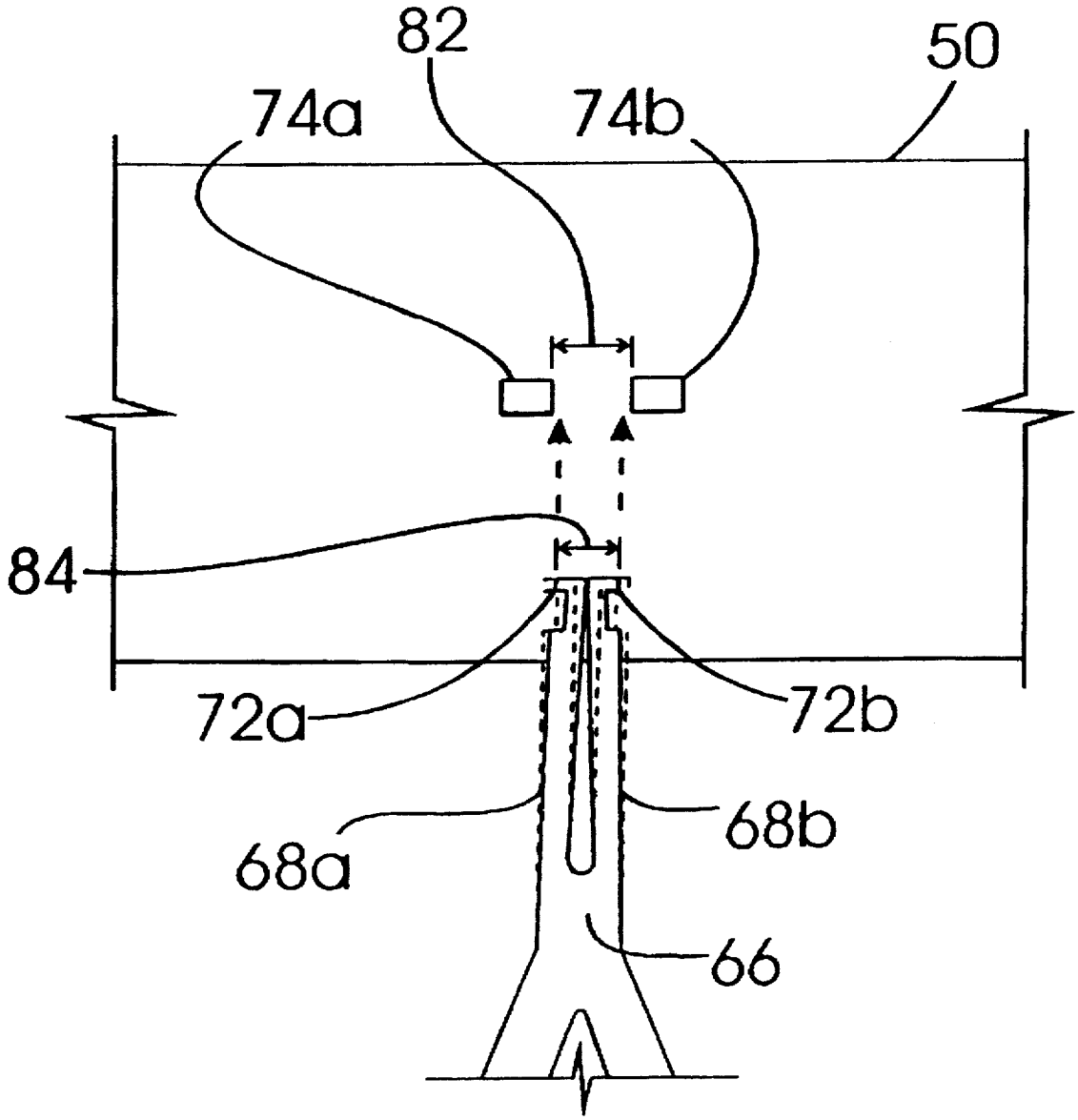
FIG. 7 is a partial back view of an alternative embodiment of the picture frame showing the cooperation between the brace and the retainer rings.

FIG. 7 further illustrates the cooperation between the pins 72*a*, 72*b* and the retainer rings, 74*a*, 74*b*. When pressed together, the arms 68*a* and 68*b* will deflect to a first configuration, shown in FIG. 7 as a solid line. In this first configuration, the pins 72*a* and 72*b* are separated by a distance 84. The distance 84 between the pins 72*a* and 72*b* is narrower than the gap 82 separating the retainer rings, 74*a* and 74*b*. Consequently, the pins 72*a* and 72*b* can be fitted between the retainer rings, 74*a* and 74*b*.

Once fitted between the retainer rings 74*a* and 74*b*, the arms 68*a* and 68*b* are released. Upon release, the arms 68*a* and 68*b* move away from each other to a second configuration, shown in FIG. 7 as hidden lines. As the arms 68*a* and 68*b* move apart, the pins 72*a* and 72*b* are inserted into the holes 78*a*, 78*b* in the respective retainer rings 74*a* and 74*b*. In the second configuration, the arms 68*a* and 68*b* are at rest in a substantially parallel alignment, such that the pins 72*a* and 72*b* are held within the holes 78*a*, 78*b* in the retainer rings 74*a* and 74*b*. It is in this manner that the brace 66 is affixed to the base S0 in a desired position. The brace 66 is detachable from the base 50 by pressing the arms 68*a* and 68*b* together to the first configuration, whereupon the pins 72*a* and 72*b* will disengage from the holes (not shown) in the retainer rings 74*a* and 74*b*.

It will be appreciated by the skilled artisan that the retainer rings 76*a* and 76*b* are, in all respects similar to the retainer rings 74*a* and 74*b*. The difference between the respective pair of rings 74 and 76 being, of course, their position on the frame base 50. In relative terms, if brace 66 holds the base 50 in a vertical orientation when engaged with retainer rings 74*a* and 74*b*, the brace 66 will hold the base 50 in a horizontal orientation when it is engaged with retainer rings 76*a* and 76*b*.

While the particular IMPROVED FRAME WITH PICTURE HOLDER as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A frame assembly for holding a picture which comprises:

a base member having a first side and a second side, said base being formed with a recess on said first side and having an aperture formed through said base member for access to said recess from said second side, said base member being further formed with an integral rim surrounding said aperture and with a pair of retainer rings projecting from said rim on said second side thereof;

a transparent sheet attached to said first side of said base member to cover said recess and to create a pocket between said sheet and said base member for receiving said picture therein through said aperture; and a brace formed with a pair of flexible arms extending therefrom to establish a space therebetween, each said arm defining a longitudinal axis and being formed with a pin oriented substantially perpendicular to said longitudinal axis, and with said pins of said respective arms being coaxial and opposedly extending from said arms for movement therewith between a first configuration wherein said pins can pass between said retainer rings and a second configuration wherein said pins are inserted into a respective said retainer ring for holding said frame assembly with said brace in a desired position.

2. A frame assembly as recited in claim 1 wherein said recess is substantially rectangular and defined by a periphery and said base member is formed with a ledge at said periphery of said recess for engagement with said sheet.

3. A frame assembly as recited in claim 1 wherein said base further comprises a second pair of retaining rings projecting from said rim on said second side of said base.

4. A frame assembly as recited in claim 3 wherein:

said base is substantially rectangular and said rim has four sides; and said pair of retaining rings and said second pair of retaining rings are respectively located on adjacent sides of said rim for providing at least two predetermined orientations for attaching said brace to said base.

5. A frame assembly as recited in claim 4 wherein said sheet is substantially rectangular.

6. A frame assembly as recited in claim 1 wherein said base and said brace are made of a rigid material.

7. A frame assembly as recited in claim 1 further comprising a border attached to said rim on said first side of said base and further including an aperture formed therein for viewing said picture therethrough.

8. A frame assembly as recited in claim 7 wherein said border further comprises:

a support member having a first surface and a second surface;

a first layer formed with a design, said first layer with said design being attached to said first surface of said support member; and a second layer attached to said second surface of said support member.

9. A frame assembly as recited in claim 8 wherein said support member is of a foam core construction.

10. A frame assembly as recited in claim 1 wherein said brace and said base are formed by injection molding.

* * * * *